US010441984B1

(12) United States Patent
Brochman

(10) Patent No.: US 10,441,984 B1
(45) Date of Patent: Oct. 15, 2019

(54) CONDUIT BENDER

(71) Applicant: Todd Brochman, White Bear Lake, MN (US)

(72) Inventor: Todd Brochman, White Bear Lake, MN (US)

( * ) Notice: Subject to any disclaimer, the term of this patent is extended or adjusted under 35 U.S.C. 154(b) by 0 days.

(21) Appl. No.: 16/247,211

(22) Filed: Jan. 14, 2019

(51) Int. Cl.
*B21D 7/00* (2006.01)
*B21D 7/06* (2006.01)

(52) U.S. Cl.
CPC ..... *B21D 7/06* (2013.01)

(58) Field of Classification Search
CPC ..... B21D 7/02; B21D 7/022; B21D 7/024; B21D 7/04; B21D 7/06; B21D 7/063; B21D 7/08
See application file for complete search history.

(56) References Cited

U.S. PATENT DOCUMENTS 4,843,858 A * 7/1989 Grimm ..... B21D 7/024 72/149
6,026,668 A * 2/2000 Oda ..... B21D 7/022 72/217
7,293,362 B2 11/2007 Konen
7,900,495 B2 3/2011 Latoria
9,718,108 B2 8/2017 Latoria
2008/0190164 A1 8/2008 Boon et al.
2009/0188291 A1 7/2009 Itrich et al.
2013/0180053 A1* 7/2013 Rubin ..... B25F 1/04 7/118
2017/0274437 A1* 9/2017 Klinger ..... B21D 7/063

FOREIGN PATENT DOCUMENTS

CN 107350316 * 11/2017 ..... B21D 7/02

OTHER PUBLICATIONS actoolsupply.com Sales Brochure, 2 pages, accessed Sep. 2018.

* cited by examiner

*Primary Examiner* — Debra M Sullivan
(74) *Attorney, Agent, or Firm* — Patterson Thuente Pedersen, P.A.

(57) ABSTRACT

A portable, self-contained conduit bender having a housing configured to house a reductive gear set, thereby improving safety and extending the life of the conduit bender by limiting exposure of the reductive gear set to dust and debris. The conduit bender includes a motor configured to drive a driven shaft at a first rotational output, a reductive gear set operably coupling the driven shaft to an output shaft, the reductive gear set configured to reduce the first rotational output of the driven shaft to a second rotational output of the output shaft, a housing defining an interior cavity configured to house the reductive gear set, such that only a portion of the output shaft emerges from the interior cavity, and a bender shoe coupleable to the output shaft, the bender shoe defining an arcuate channel configured to receive conduit during bending operations.

19 Claims, 14 Drawing Sheets

(Section AA)

CONDUIT BENDER

TECHNICAL FIELD

The present disclosure relates generally to conduit benders, and more particularly to portable, self-contained conduit benders.

BACKGROUND

Electrical conduit is a thin-walled tubing used to protect and route electrical wiring in a building or structure. Electrical conduit, often in the form of Electrical Metallic Tubing (EMT), is constructed of straight elongated sections of corrosion resistant galvanized steel of about 10 feet in length, with a diameter of between about ½ and 4 inches. For example, EMT with standard trade size designations of ½ inch, ¾ inch, 1 inch, and 1¼ inch are commonly installed by electricians at the site of installation of electrical equipment, and in compliance with the U.S. National Electric Code (NEC) and other building codes.

Prior to installation, it is often necessary to bend the conduit. This can be accomplished with a manually operated tool known as a conduit bender, which provides a desired bend in the conduit without collapsing the conduit walls. A typical conduit bender includes a handle and a head. The head is generally a one-piece construction, including an arcuate shoe with a lateral concave channel for supporting the conduit. A hook is generally formed into the head proximate to one end of the channel for engaging a portion of conduit received in the channel. The handle, which is generally about 2 to 3 feet long, is secured to the head and is generally positioned in a radial line relative to the arcuate shoe. Such manually operated conduit benders are commonly produced by companies such as Benfield Electric Co., Gardner Bender, Greenlee Tools, Ideal Industries, Klein Tools, and NSI Industries, among others.

To bend the conduit, a length of conduit is positioned on a supporting surface, such as the ground, with a portion of the conduit positioned within the channel of the arcuate shoe, such that the hook of the conduit bender engages the conduit. The handle is then forced to roll the shoe onto the conduit, thereby bending the conduit to fill in the arcuate channel. Accordingly, the use of a manually operated conduit bender requires a stable work surface, as well as space sufficient to manipulate the handle relative to the conduit. For larger size conduit, such as EMT with a designated standard size of a 1 inch or greater, the bending may be assisted by an electric, hydraulic or pneumatic motor. Various heavy-duty wheeled or bench mounted benders are produced by companies such as Greenlee Tools, among others.

Frequently installations require the conduit to be routed along the ceiling or parts of a building structure that are normally out of reach when standing on the ground. In such instances, it is common to utilize a lift, frequently referred to as a "cherry picker," to safely access the intended conduit route. However, given the limited size of the platform or basket of most lifts, and the lack of a stable horizontal work surface, it is difficult to operate a manual conduit bender while using the lift. Accordingly, most electricians bend the conduit on the ground before loading the conduit onto the lift and ascending to the installation location. If it is determined that additional bending is required, the electrician must then descend back to the ground to conduct the additional bending. In some instances, multiple ascents and descents are required to complete the electrical routing, all of which can significantly add to the time and expense of the electrical conduit installation. Further, in some instances, the electrician may be working with multiple conduit diameters, each of which requires its own specific tool to complete the desired bends.

Recent advances in conduit bending have seen an introduction of portable powered conduit benders. Various examples of such powered benders are disclosed in U.S. Pat. Nos. 7,900,495; 9,718,108 and U.S. Patent Publication No. 2009/0188291, assigned to Husky Tools, Inc. Another example of a bending apparatus is disclosed in U.S. Patent Publication No. 2008/0190164. The aforementioned disclosures are hereby incorporated by reference herein to the extent that they do not contradict teachings of the present disclosure.

Although these benders are satisfactory for their intended purpose, all include a single large exposed, single stage gear drive, which makes the bender both bulky and invites the possibility of injury, as the gear drive includes a pinch point which can bite the user or grab an article of clothing, such as a shirtsleeve, neck lanyard or safety vest. Further, exposure of the drive gear invites the possibility of inadvertent introduction of foreign matter between the gears, which can permanently damage the bender, thereby decreasing its usable life. The present disclosure addresses these concerns.

SUMMARY OF THE DISCLOSURE

Embodiments of the present disclosure provide a portable, self-contained conduit bender having a housing configured to house a reductive gear set and motor. Accordingly, the housing is configured to improve user safety by acting as a shield to inhibit inadvertent contact with pinch points, rapidly rotating members and other potentially hazardous mechanical components of the conduit bender, and to extend the life of the conduit bender by limiting exposure of the reductive gear set and motor to dust and debris common in the work environment. Further, in some embodiments, a compound reductive gear set can be utilized to provide a more compact construction. In one embodiment, the compound reductive gear set can include at least one gear in contact with two other gears, Such contact can include fixed coupling of the rotational axis of at least one gear to the rotational axis of another gear. In one embodiment, the compound reductive gear set can for example employ a train of at least three gears.

One embodiment of the present disclosure provides a portable, self-contained conduit bender including a motor, reductive gear set, housing, and bender shoe. The motor can be configured to drive a driven shaft at a first rotational output. The reductive gear set can operably couple the driven shaft to an output shaft. The reductive gear set can be configured to reduce the first rotational output of the driven shaft to a second rotational output of the output shaft. The housing can define an interior cavity configured to house the reductive gear set, such that only a portion of the output shaft emerges from the interior cavity. The bender shoe can be coupleable to the output shaft, and can define an arcuate channel configured to receive conduit during bending operations.

In one embodiment, the arcuate channel of the bender shoe can be configured to receive at least one of Electrical Metallic Tubing (EMT), Rigid Metal Conduit (RMC), Intermediate Metal Conduit (IMC), stainless steel tubing, copper tubing, tubing used for HVAC or refrigeration systems, tubing used in elevator systems, and other types of tubing or conduit. In one embodiment, the output shaft can include a quick release configured to enable ease in interchangeability and detachability in the coupling of any of two or more bender shoes to the output shaft.

In one embodiment, the conduit bender can further include a bearing wheel configured to guide and support conduit during bending operations. In one embodiment, the bearing wheel can be driven by an actuation motor to a desired distance from the output shaft to accommodate conduit of varying sizes. In one embodiment, the conduit bender can include a built-in level configured to aid in leveling the conduit bender relative to a gravitational frame of reference along at least x-axis and y-axis. In one embodiment, the motor can be at least one of electrically, hydraulically, or pneumatically powered.

In one embodiment, the conduit bender can include a sensor configured to sense an angular position of the bender shoe relative to the housing. In one embodiment, the conduit bender can include a display configured to display a digital readout of an angular position of the bender shoe. In one embodiment, the display can further include a user interface configured to accept input from a user. In one embodiment, the user interface can be configured to accept a desired angular position of the bender shoe relative to the housing. In one embodiment, the conduit bender can include a programmable controller configured to automatically cease operation of the motor upon reaching the desired angular position as determined by the sensor. In one embodiment, the conduit bender can further include a worklight configured to illuminate a portion of conduit in proximity to the bender shoe during bending operations.

Another embodiment of the present disclosure provides a conduit bender including a motor, reductive gear set, housing, and bender shoe. The motor can be configured to drive a driven shaft at a first rotational output. The reductive gear set can operably couple the driven shaft to an output shaft. The reductive gear set can be configured to reduce the first rotational output of the driven shaft to a second rotational output of the output shaft. The housing can define a handgrip enabling user manipulation of the conduit bender, and an interior cavity configured to house the reductive gear set, such that only a portion of the output shaft extends to an exterior of the housing. The bender shoe can be coupleable to the output shaft.

Another embodiment of the present disclosure provides a method of constructing a conduit bender, including: forming a housing defining an interior cavity and a handgrip; positioning a motor configured to rotationally drive a driven shaft within the interior cavity; positioning a reductive gear set configured to operably couple the driven shaft to an output shaft within the interior cavity, such that only a portion of the output shaft emerges from the interior cavity; and forming a bender shoe coupleable to the output shaft.

Another embodiment of the present disclosure provides a portable conduit bender including a motor, a reductive gear set, a bender shoe, and an actuatable bearing wheel. The motor can be configured to rotationally drive a driven shaft. The reductive gear set can operably couple the driven shaft to an output shaft. The bender shoe can be coupleable to the output shaft, and can define an arcuate channel configured to receive conduit during bending operations. The actuatable bearing wheel can be configured to be driven by an actuation motor to a desired distance from the output shaft to accommodate conduit of varying sizes.

In one embodiment, the conduit bender can further include a user interface configured to accept input from the user. In one embodiment, the user interface can be configured to enable manual adjustment of the actuatable bearing wheel via the actuation motor. In one embodiment, the user interface can be configured to accept a desired conduit size, such that during bending operations a programmable controller operably coupled to the user interface automatically drives the actuatable bearing wheel to the desired distance from the output shaft via the actuation motor based on the accepted desired conduit size. In one embodiment, the user interface can be configured to accept a desired conduit bend angle, such that upon activation of the motor a programmable controller operably coupled to the user interface can automatically cease power to the motor upon bending conduit to the desired angle. In one embodiment, the programmable controller can further be configured to automatically drive the actuatable bearing wheel from an initial position to the desired distance from the output shaft via the actuation motor prior to commencing bending operations, and return the actuatable bearing wheel to the initial position via the actuation motor upon ceasing power to the motor.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
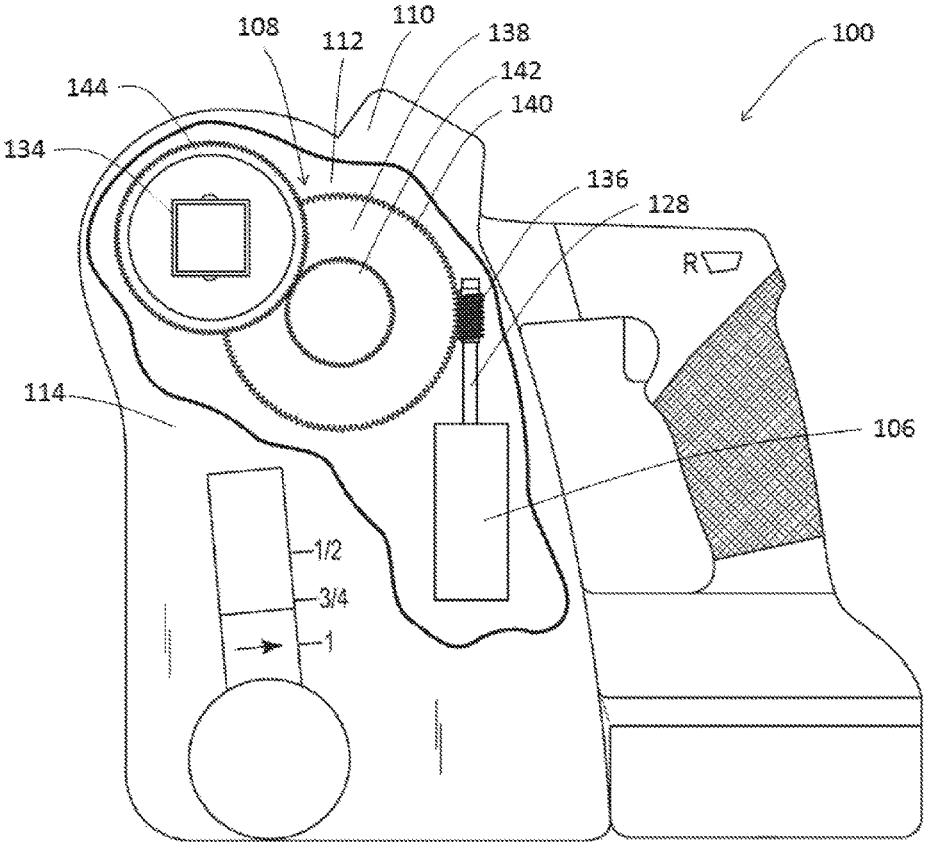
FIG. 1 is a partial cutaway left side profile view depicting a conduit bender having components internal to a housing of the conduit bender, in accordance with an embodiment of the disclosure.

While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

DETAILED DESCRIPTION

Referring to FIG. 1, a portable conduit bender 100 is depicted in accordance with an embodiment of the disclosure. The portable conduit bender 100 can be configured to enable a user to bend conduit, such as Electrical Metallic Tubing (EMT), Rigid Metal Conduit (RMC), Intermediate Metal Conduit (IMC), copper tubing, tubing used for HVAC or refrigeration systems, or tubing used in elevator systems, or other types of tubing or conduit, in a confined area, such as the platform of a lift or other limited workspace. The portable conduit bender 100 can be configured to bend conduit of a number of standard trade size designations (e.g., ⅜ inch, ½ inch, ¾ inch, 1 inch, 1¼ inch, 1½ inch, 2 inch, 2½ inch, 3 inch, 3½ inch, 4 inch, etc.), or generally conduit having a diameter of between about ⅜ inch (9.5 mm) and about 4 inches (101.6 mm). The portable conduit bender 100 can be configured to bend the conduit through a range of angles between about 0° and about 180° over a time span of up to about 60 seconds, depending upon the bend angle desired.

In one embodiment, the conduit bender 100 can be self-contained, such that a motor 106 and at least a portion of a reductive gear set 108 reside within a protective housing 110. Accordingly, the housing 110 can define an interior cavity 112 configured to house at least a portion of the reductive gear set 108, such that only a portion of the reductive gear set 108 emerges from the cavity 112 to extend to an exterior surface 114 of the housing 110, thereby improving user safety by shielding drive system pinch points and rotating components which can bite the user or grab an article of clothing, as well as to extend the life of the conduit bender 100 by limiting exposure of the reductive gear set 108 and motor 106 to foreign articles, such as dust and debris.

With additional reference to FIGS. 2A-D, which respectively depict a left side profile, right side profile, front, and top views of a portable bender 100, in accordance with an embodiment of the disclosure, the housing 110 can be constructed of a rigid or semi rigid material, such as plastics, fiberglass, composites, or lightweight metals, such as aluminum or magnesium. In some embodiments, the housing 110 can define a handgrip 116 configured to enable a user to readily grip the conduit bender 100 for ease in maneuverability and use. In one embodiment, the housing 110 can include a leveling device 118 (as depicted in 2D), configured to serve as an aid in leveling the conduit bender 100 relative to a gravitational frame of reference along at least one of an x-axis and y-axis. For example, in one embodiment, the leveling device 118 can be a bubble level, such as a bull's-eye bubble level, or some other type of leveling tool, such as a magnetic level. In some embodiments, the leveling device 118 can be included within a display 120/keypad 122, which in some embodiments can be incorporated into the housing 110.

Figure 2A:
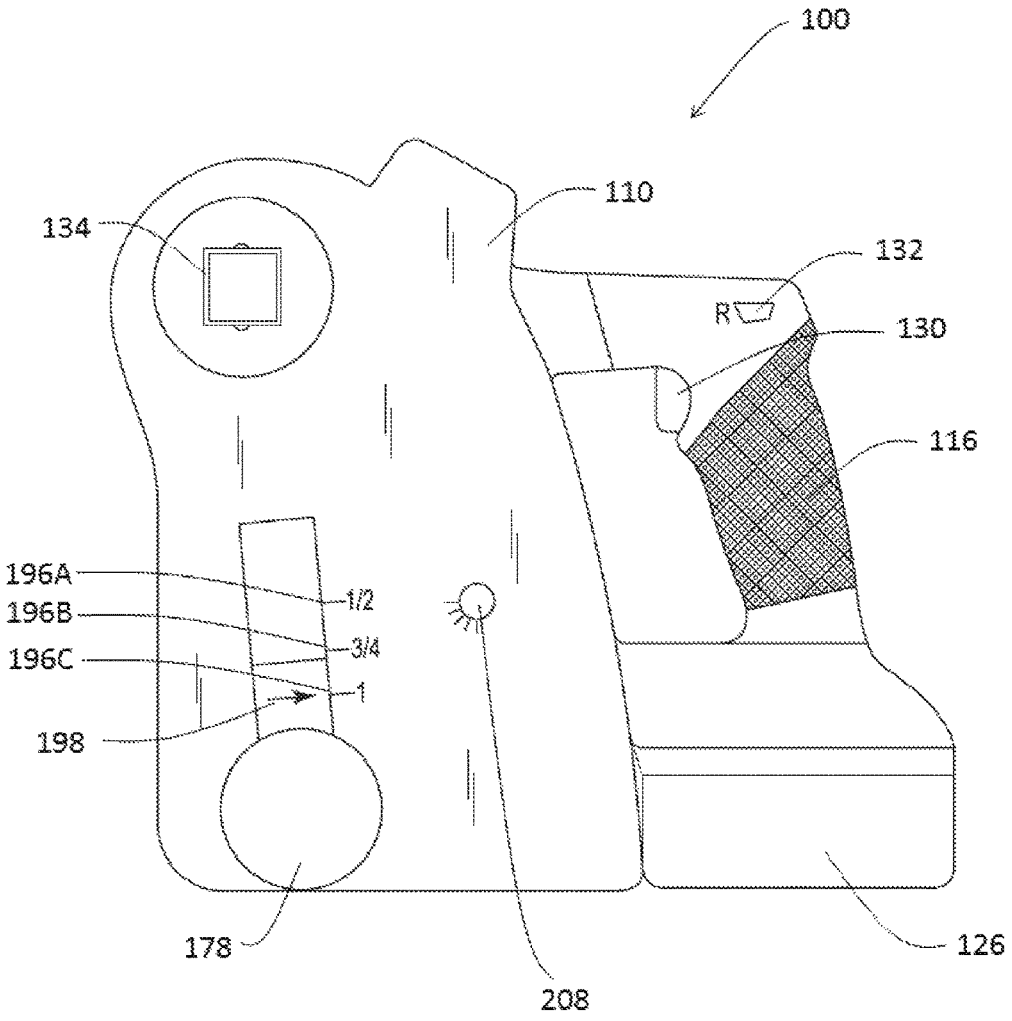
FIG. 2A is a left side profile view depicting a conduit bender in accordance with an embodiment of the disclosure.
Figure 2B:
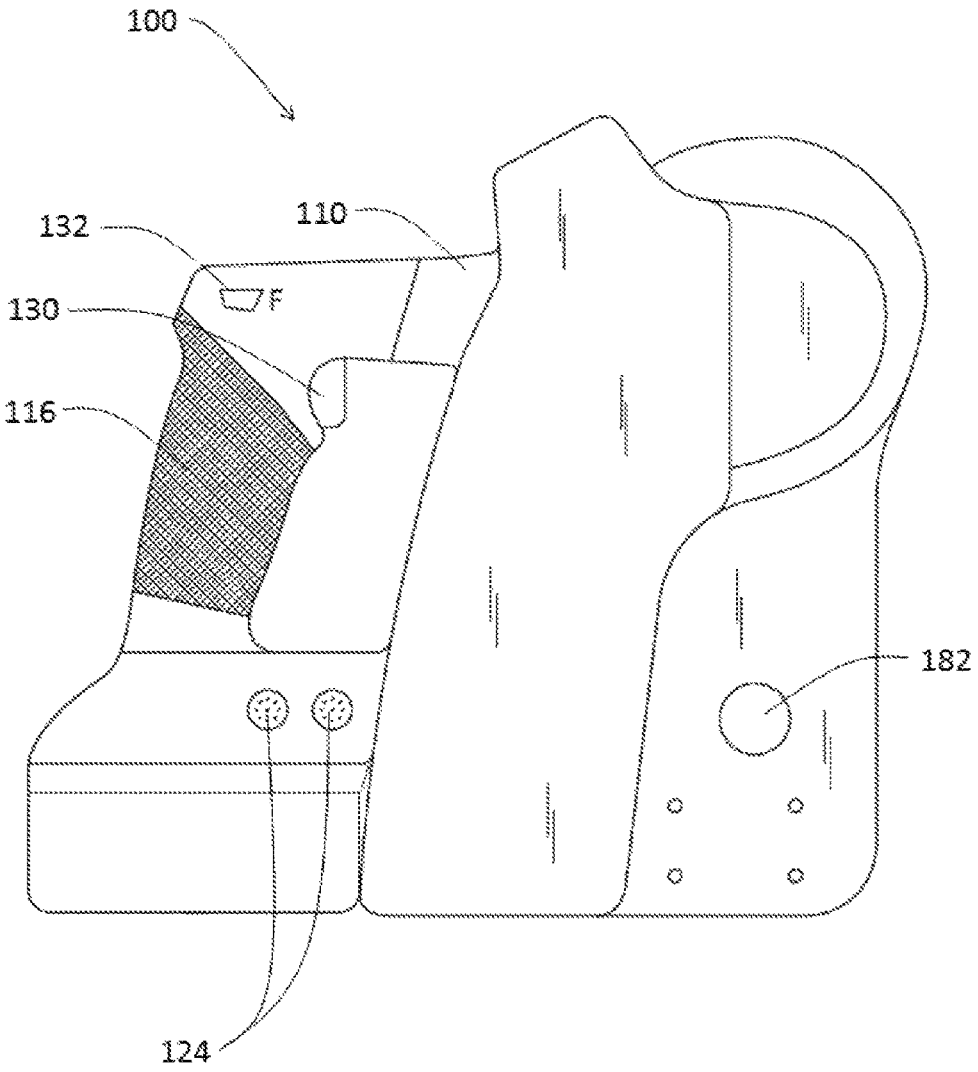
FIG. 2B is a right side profile view depicting the conduit bender of FIG. 2A.
Figure 3A:
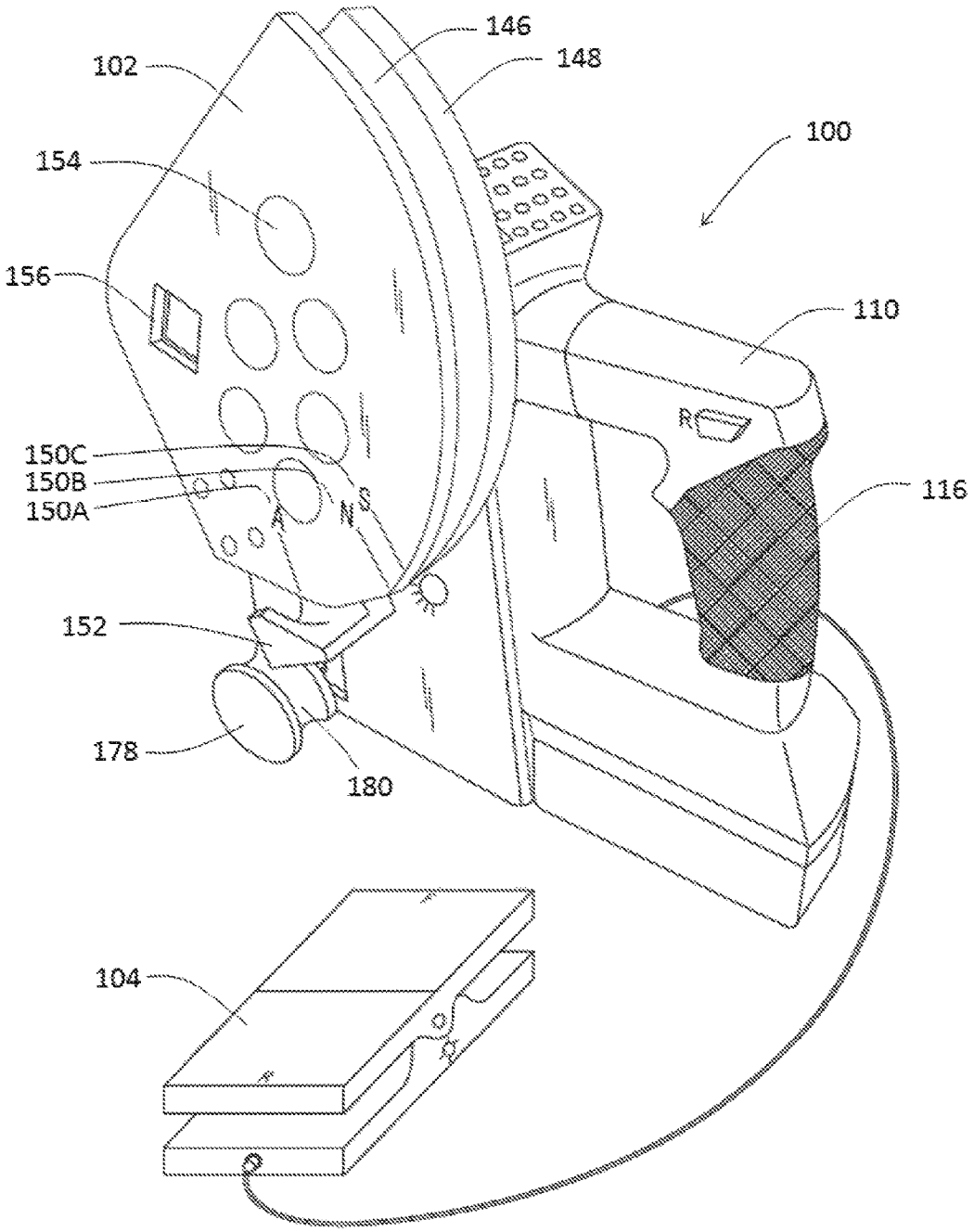
FIG. 3A is a perspective view depicting a conduit bender having a bender shoe and a remote user interface, in accordance with an embodiment of the disclosure.
Figure 3B:
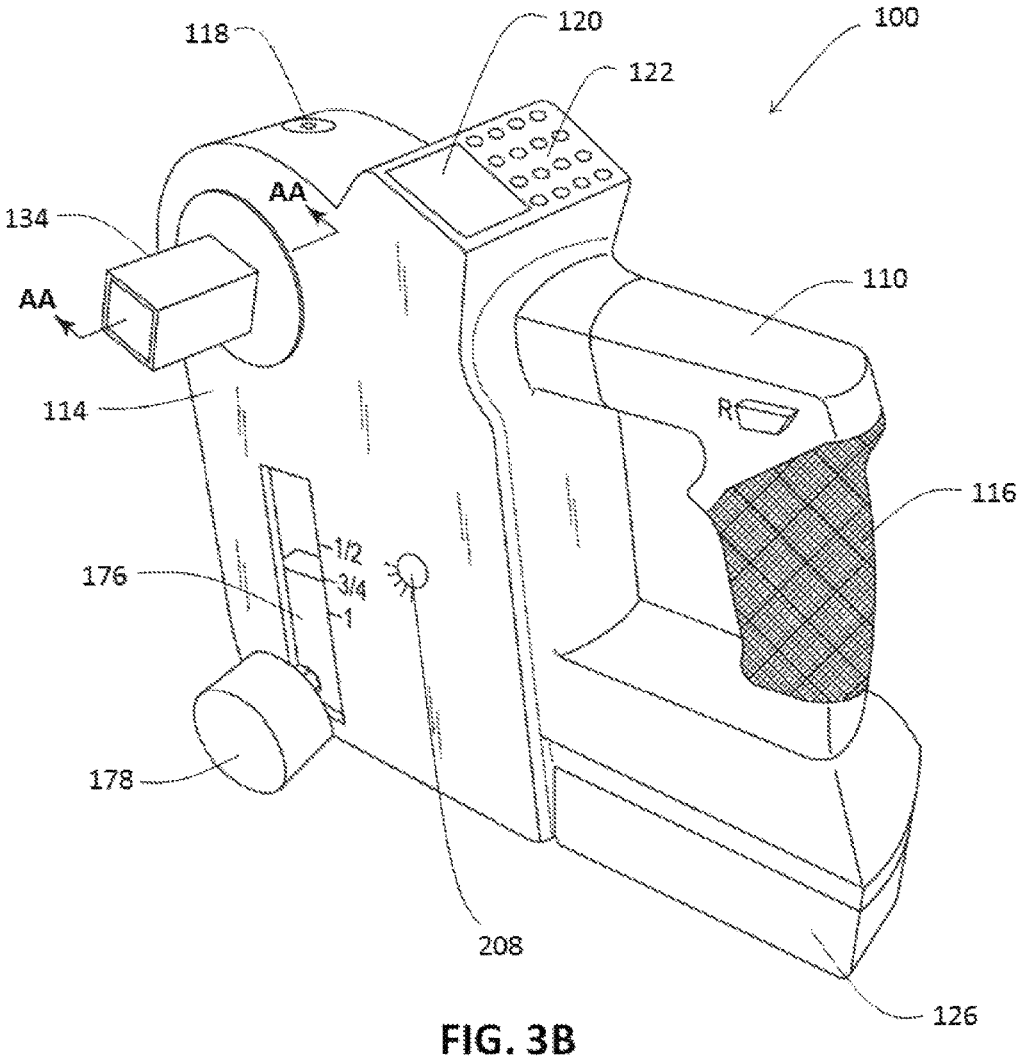
FIG. 3B is a perspective view depicting a conduit bender without a bender shoe attached, in accordance with an embodiment of the disclosure.
Figure 10:
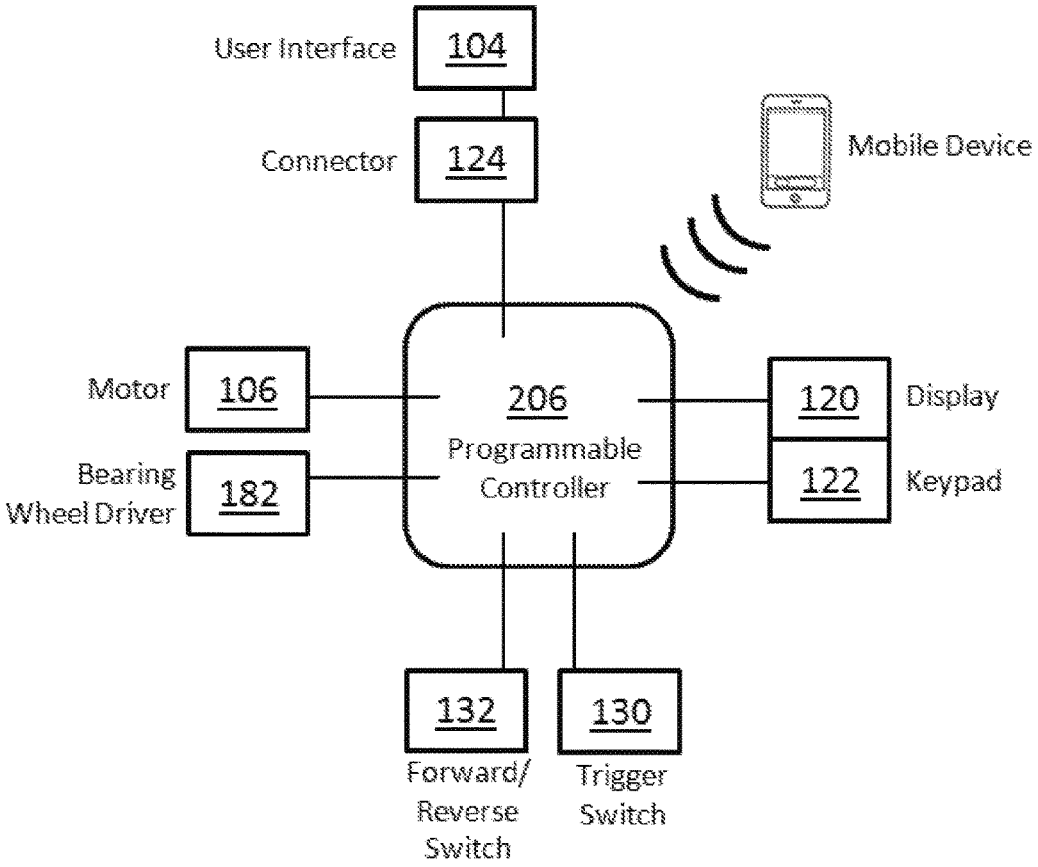
FIG. 10 is a schematic view depicting a programmable controller for a conduit bender, in accordance with an embodiment of the disclosure.

FIG. 3A depicts a conduit bender 100 optionally coupled to a remote user interface 104, in accordance with an embodiment of the disclosure. FIG. 3B depicts a conduit bender 100, with the optional remote user interface 104 selectively removed. In some embodiments, the housing 110 can define one or more electrical connectors 124 (as depicted in FIG. 2B) configured to enable coupling of a user interface 104, such as a foot switch (as depicted in FIG. 3A) or mobile computing device (e.g., a cellular phone or tablet, as depicted in FIG. 10) to the conduit bender 100. In other embodiments, one or more external or remote user interfaces 104 can communicate with the conduit bender 100 via a wireless connection.

With continued reference to FIGS. 1-3B, in one embodiment, the motor 106 can be fixedly coupled to the housing 110 within the interior cavity 112. In some embodiments, the motor 106 can be powered by a battery pack 126, which can be removable and rechargeable. In some embodiments, the motor 106 can be electrically (e.g., AC or DC power), pneumatically, or hydraulically operated. The motor 106 can be configured to rotate a driven shaft 128 at a first rotational output. The motor 106 can be controlled via a plurality of inputs. For example, in one embodiment, the first rotational output can be started, stopped and otherwise controlled for speed, duration or both speed and duration via a trigger 130 (as depicted in FIG. 2A) or other input, for example, mounted within the handgrip 116 of the housing 110. In other embodiments, actuation of the motor 106 can be controlled via another user input, such as a foot switch 104 (as depicted in FIG. 3A). Forward and reverse directional control of the first rotational output can be controlled via a forward and reverse switch 132 (as depicted in FIG. 2A), which can optionally be mounted in proximity to the handgrip 116 of the housing 110. In other embodiments, one or more of actuation, speed, duration, and directional control of the first rotational output can be controlled, at least in part, by a programmable controller.

With specific reference to FIG. 1, the reductive gear set 108 can be configured to operably couple the driven shaft 128 to an output shaft 134, thereby reducing the first rotational output of the driven shaft 128 to a second rotational output of the output shaft 134. The reductive gear set 108 can be made up of a plurality of different gearing types and configurations to achieve the desired reduction in RPM and corresponding increase in torque necessary to bend conduit. For example, in one embodiment, the reductive gear set 108 can include a worm gear 136, a compound gear 138 (in which a number of gears, such as a first gear 140 and a second gear 142 are fixedly coupled together), and an output gear 144. In one embodiment, the worm gear 136 can be coupled to the driven shaft 128, and the output gear 144 can be coupled to the output shaft 134.

Figure 4:
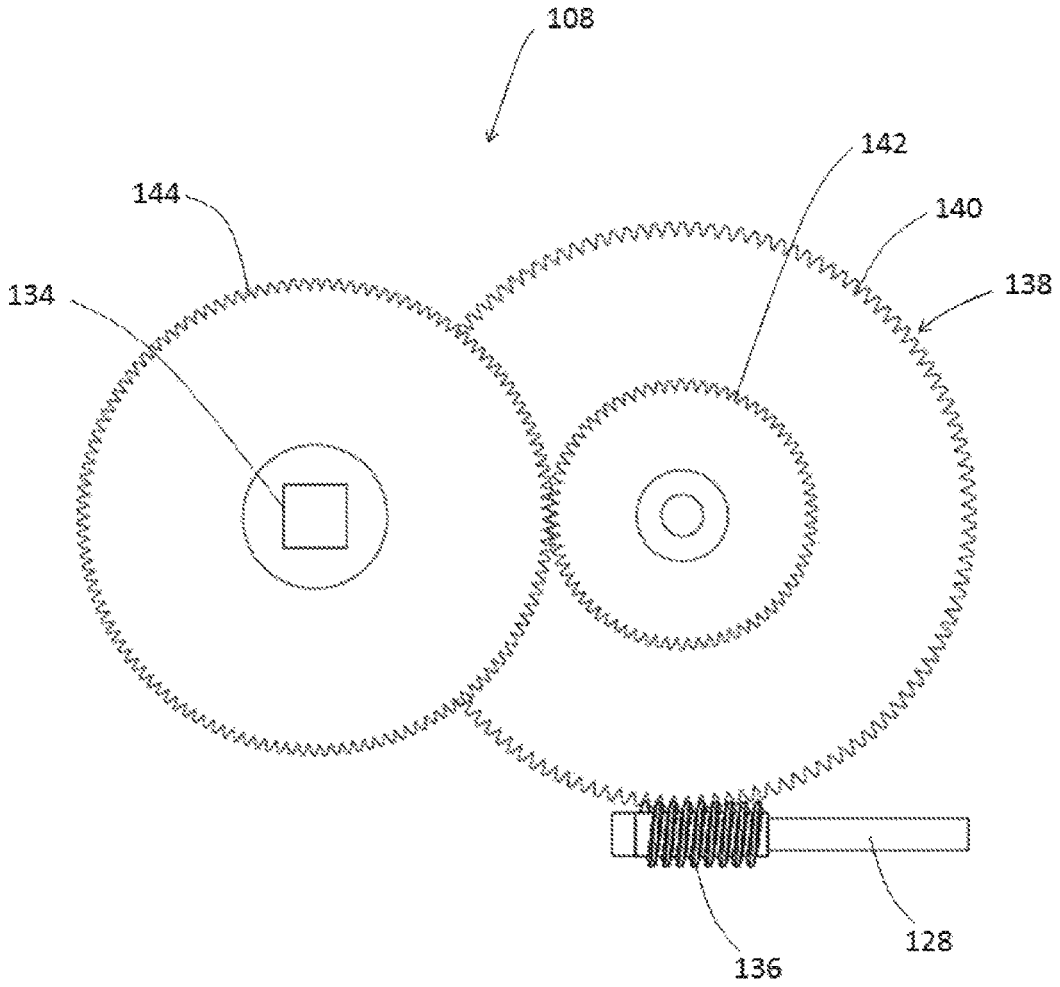
FIG. 4 is a schematic view depicting a compound reductive gear set, in accordance with a first embodiment of the disclosure.

In one embodiment, the reductive gear set 108 can be constructed of a high strength, rigid material, such as steel; although other materials, such as light weight, high-strength alloys and composites are also contemplated. With reference to FIG. 4, in one non-limiting, exemplary embodiment, the first rotational output of the driven shaft 128 can rotate between a clockwise rotation of about 450 RPM and a counterclockwise rotation of about 450 RPM; although other rotational speeds are also contemplated. The worm gear 136 can be coupled to the driven shaft 128, so as to rotate at the same speed. The first gear 140 of the compound gear 138, which can be configured to interface with the worm gear 136, can include the appropriate number of teeth to reduce the first rotational output by a desired factor (e.g, a factor of ten). For example, in one embodiment, the first gear 140 can include about 100 teeth. Accordingly, the first gear 140 can rotate between a clockwise rotation of about 4.5 RPM and a counterclockwise rotation of about 4.5 RPM. The second gear 142 of the compound gear 138 can be coupled to the first gear 140, so as to rotate at the same speed. In one embodiment, the second gear 142 can have a fewer number of teeth than the first gear 140. For example, in one embodiment, the second gear 142 can include about 20 teeth. The output gear 144, which can be configured to interface with the second gear 142, can include the appropriate number of teeth to further reduce the rotational speed of the compound gear 138 to the desired second rotational output. For example, in one embodiment, the output gear 144 can include about 90 teeth. Accordingly, the output gear 144 can rotate between a clockwise rotation of about 1 RPM and a counterclockwise rotation of about 1 RPM. The output shaft 134 can be coupled to the output gear 144, so as to rotate at the same speed. Accordingly, in some embodiments, the reductive gear set 108 can be configured to complete a 90° conduit bend over the course of about 15 seconds of operation; although, other rotational output speeds are also contemplated. For example, in one embodiment, the portable conduit bender 100 can be configured to bend conduit through a range of angles between about 0° and about 180° over a time span of up to about 60 seconds, depending upon the bend angle desired.

Figure 5:
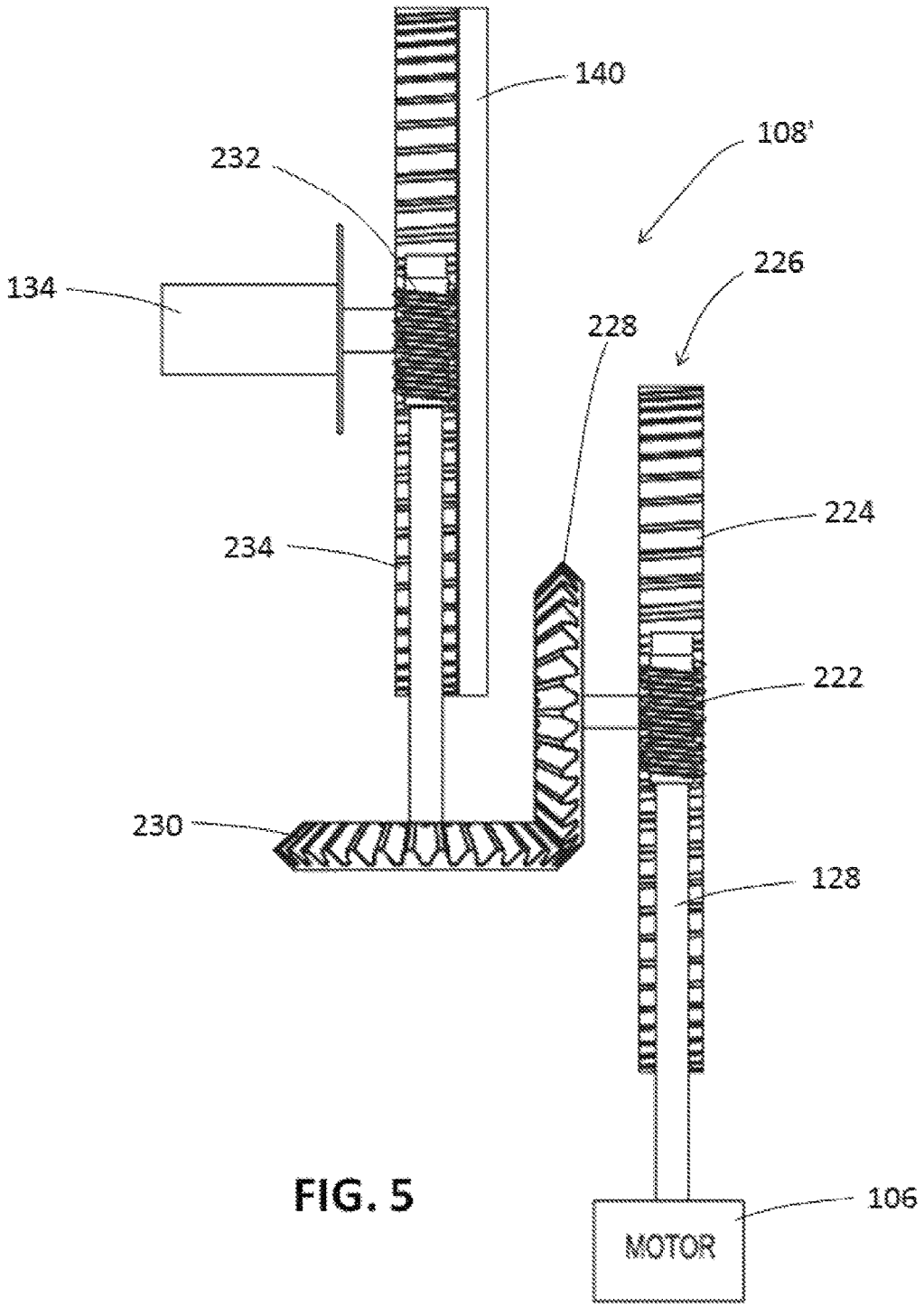
FIG. 5 is a schematic view depicting a compound reductive gear set, in accordance with a second embodiment of the disclosure.

With reference to FIG. 5, an alternative reductive gear set 108' configuration is contemplated. In this exemplary embodiment, the first rotational output of the driven shaft 128 can be driven by a motor 106 to be rotated at a first rotational output of between a clockwise rotation of about 10,000 RPM and a counterclockwise rotation of about 10,000 RPM; although other rotational speeds are also contemplated. A worm gear 222 can be coupled to the driven shaft 128, so as to rotate at the same speed. A first gear 224 of a compound gear 226 (in which a first gear 224 can be fixedly coupled to a first bevel gear 228), which can be configured to interface with the worm gear 222, can include the appropriate number of teeth to reduce the first rotational output by a desired factor (e.g., a factor of about 100). For example, in one embodiment, the first gear 224 can include about 100 teeth. Accordingly, the first gear 224 can rotate between a clockwise rotation of about 100 RPM and a counterclockwise rotation of about 100 RPM. A first bevel gear 228 of the compound gear 226 can be coupled to the first gear 224, so as to rotate at the same speed. In one embodiment, the first bevel gear 228 can have a fewer number of teeth than the first gear 224. For example, in one embodiment, the first bevel gear 228 can include about 20 teeth. A second bevel gear 230 can be configured to interface with the first bevel gear 228. In one embodiment, the second bevel gear 230 can include the same number of teeth as the first bevel gear 228, such that the first bevel gear 228 and the second bevel gear 230 rotate at the same speed. A second worm gear 232 can be coupled to the second bevel gear 230, so as to rotate at the same speed as the second worm gear 232. An output gear 234, which can be configured to interface with the second worm gear 232, can include the appropriate number of teeth to further reduce the rotational speed to the second rotational output. For example, in one embodiment, the output gear 234 can include about 100 teeth. Accordingly, the output gear 234 can rotate between a clockwise rotation of about 1 RPM and a counterclockwise rotation of about 1 RPM. The output shaft 134 can be coupled to the output gear 234, so as to rotate at the same speed. Accordingly, in some embodiments, the reductive gear set 108' can be configured to complete a 90° conduit bend over the course of about 15 seconds of operation; although other rotational output speeds are also contemplated.

Figure 6B:
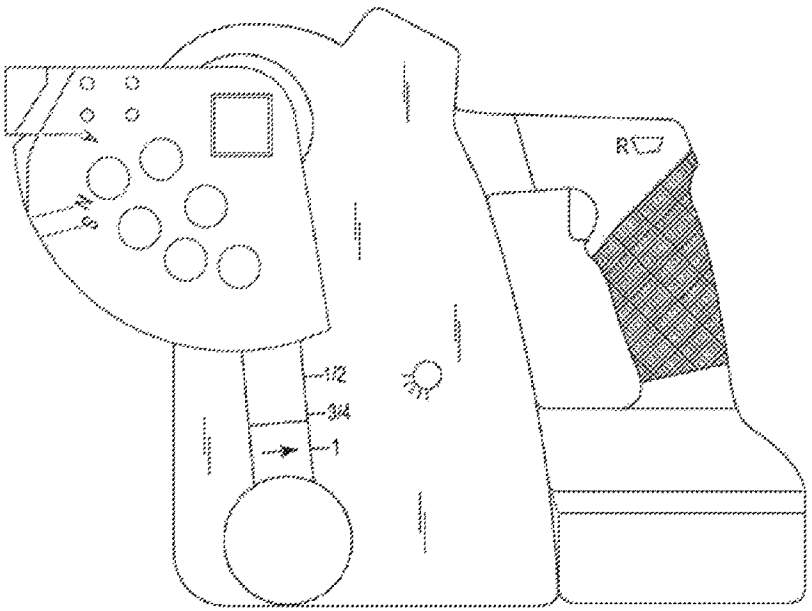
FIG. 6B is a left side plan view of the conduit bender of FIG. 6B, with the bender shoe rotated to a second position.
Figure 6A:
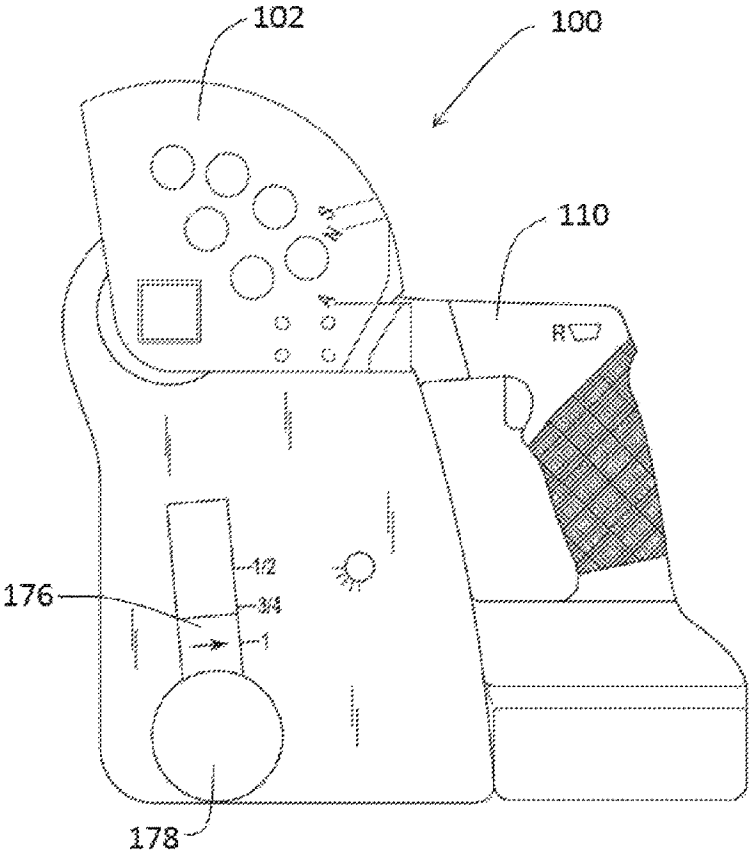
FIG. 6A is a left side plan view depicting a conduit bender having a bender shoe rotated to a first position, in accordance with an embodiment of the disclosure.

With reference to FIGS. 3A and 6A-B, one or more bender shoes 102 can be selectively coupled to the output shaft 134 to rotate across a range of motion necessary to complete desired conduit bends. As depicted in FIG. 3A, in one embodiment, the bender shoe 102 can define an arcuate channel 146 along a peripheral edge 148 of the bender shoe 102, shaped and sized to receive a cross-section of conduit of a standard trade size. The arcuate channel 146 can define a convex arc corresponding to the NEC approved a minimum bend radius for conduit of a standard trade size. Accordingly, in one embodiment, the size of the bender shoe 102 can be specific to the size of the conduit to be bent. Different sized bender shoes 102 can be provided for different sized conduit. For example, a first bender shoe can be provided for ½ inch EMT, an optional second bender shoe can be provided for three-quarter inch EMT, and optional third and fourth bender shoes can be provided for 1 and 1¼ inch EMT. In other embodiments, a combination bender shoe (not depicted) defining a plurality of arcuate channels shaped and sized to receive the different diameter conduit sizes can be provided. In some embodiments, the bending shoe 102 can be configured to bend other materials, such as Rigid Metal Conduit (RMC), Intermediate Metal Conduit (IMC), copper tubing, tubing used for HVAC or refrigeration systems, tubing used in elevator systems, and other types of tubing or conduit.

The bender shoe 102 can optionally include markings 150A-C configured to indicate the angular position of the bender shoe 102 relative to other portions of the conduit bender 100, in particular the housing 110. For example, the markings 150A-C can optionally include an arrow (A) to be used with stub, offset and outer marks of saddle bends, a rim notch (N) configured to aid in locating the center of a saddle bend, a star (S) configured to indicate the back of a 90° bend, as well as a degree scale depicting common bending angles relative to the housing 110 (e.g., 10°, 22.5°, 30°, 45°, 60°, etc.) for offset bends and saddles (not depicted).

In one embodiment, the bender shoe 102 can be constructed of a lightweight, rigid material, such as aluminum; although other materials, such as high-strength plastics and composites are also contemplated. In one embodiment, the bender shoe 102 can include a hook 152 configured to engage conduit received within the arcuate channel 146. In one embodiment, the bender shoe 102 can define a plurality of material cutouts 154, for example circular throughbores, configured to reduce the overall weight of the bender shoe 102 by removing material unnecessary for support and function.

A connection aperture 156 can be defined in the bender shoe 102 for selective coupling of the bender shoe 102 to the output shaft 134. In one embodiment, the connection aperture 156 can be configured to match a keyed cross-section of the output shaft 134. For example, the output shaft 134 can have a substantially square cross-section; although other shaft configurations, such as circular, semicircular, elliptical, triangular, polygonal, splined, or key cross-sections are also contemplated. In one embodiment, the output shaft 134 can include a quick release mechanism 158 configured to enable ease in connection and disconnection of the bender shoe 102 from the output shaft 134.

Figure 7:
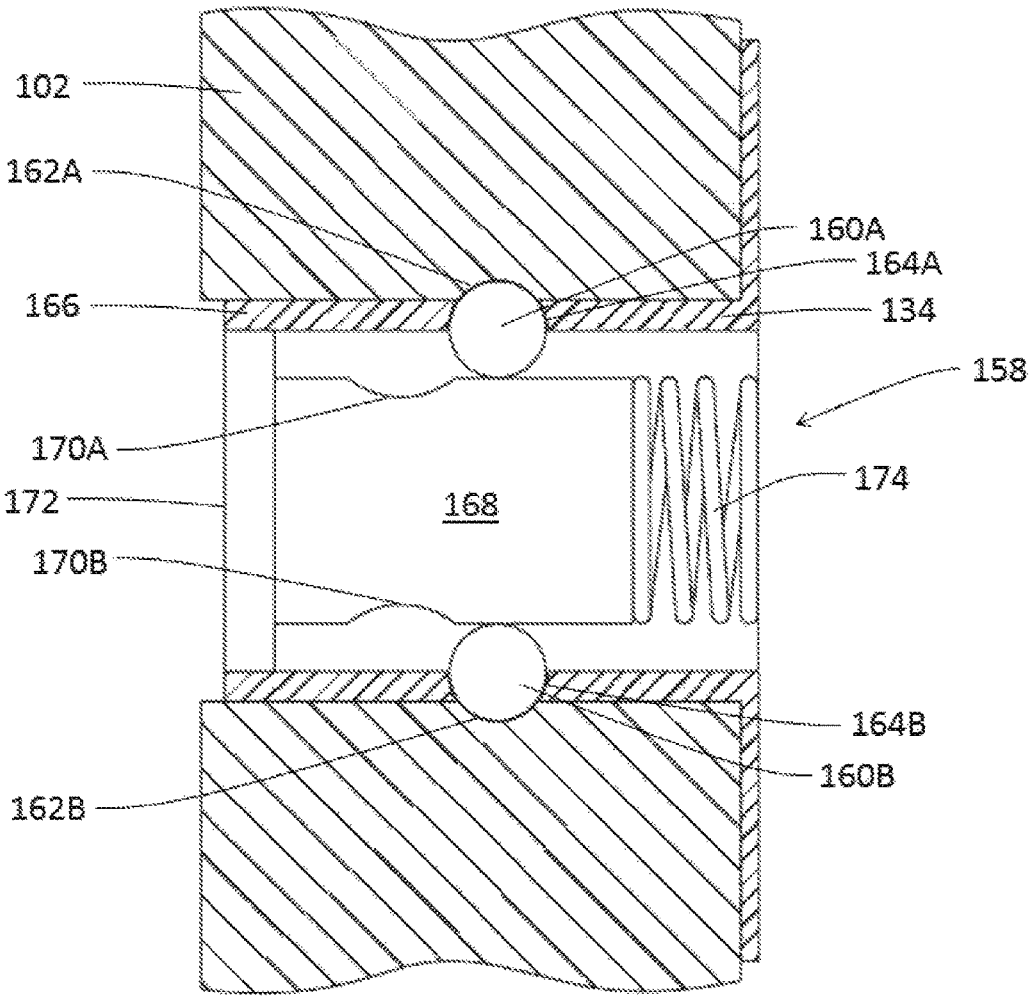
FIG. 7 is a partial cross sectional view depicting a quick release mechanism of the conduit bender of FIG. 1.

For example, with additional reference to FIG. 7, in one embodiment, the quick release mechanism 158 can include one or more outwardly biased balls 160A/B configured to interface with one or more corresponding detents 162A/B defined within the connection aperture 156. In one embodiment, the one or more balls 160A/B can be forced into one or more corresponding apertures 164A/B defined within a tubular wall 166 of the output shaft 134 into a locked position. The one or more balls 160A/B can be forced into the locked position via a release member 168, which can be shiftable between the locked position (as depicted in FIG. 7) and a release position, for example, by pressing on a release surface 172 of the release member 168. In some embodiments, the release member 168 can be biased to the locked position by a biasing element 174. In the release position, one or more detents 170A/B defined by the release member 168 can be positioned in proximity to the one or more balls 160A/B, thereby enabling the one or more balls 160 to shift inwardly into the one or more detents 170A/B and out of the one or more apertures 164A/B, such that the bender shoe 102 can be positioned over the output shaft 134.

With continued reference to FIGS. 3A-B and 6A-B, the conduit bender 100 can further include a bearing wheel assembly 176. In one embodiment, the bearing wheel assembly 176 can include a bearing wheel 178. In one embodiment, the bearing wheel 178 can have a substantially circular cross-section, which optionally can define a concave groove 180 (as depicted in FIG. 3A) shaped and sized to enable a portion of conduit to reside therein and pass therethrough. Other embodiments of the bearing wheel 178 can have an ungrooved surface (as depicted in FIG. 3B), so as to not limit use of the bearing wheel 178 to any particular conduit diameter or size.

Figure 8:
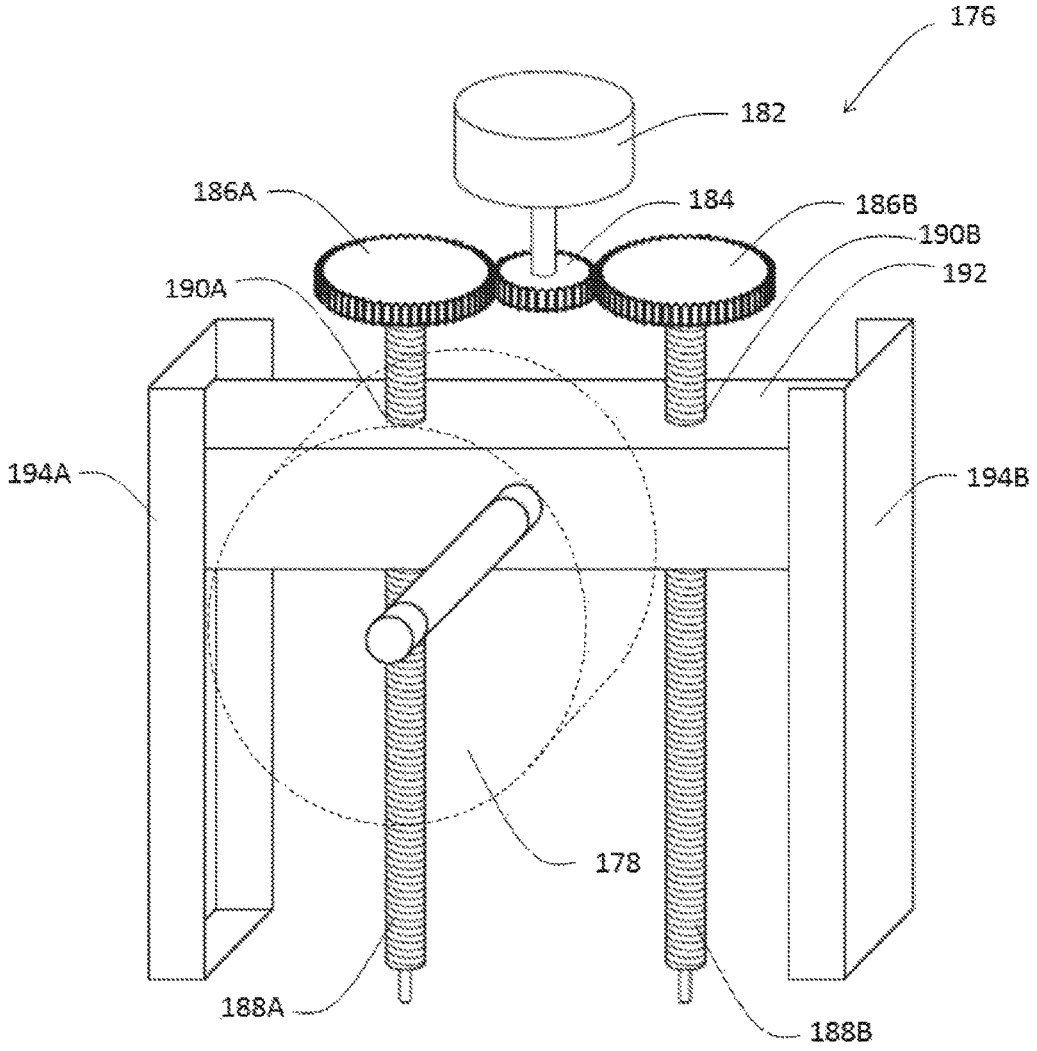
FIG. 8 is a schematic view depicting a bearing wheel assembly, in accordance with an embodiment of the disclosure.

In one embodiment, the bearing wheel assembly 178 can optionally include a mechanism for adjusting a distance of the bearing wheel 178 from the output shaft 134/bender shoe 102. For example, with additional reference to FIG. 8, in some embodiments, a position of the bearing wheel 178 relative to the housing 110 can be adjusted by a driver 182, such as an electric motor or manual adjustment knob (as depicted in FIG. 2C). In one embodiment, the driver 182 can be coupled to a first gear 184, such that the driver 182 and the first gear 184 are configured to rotate at the same speed. The first gear 184 can be configured to interface with one or more second gears 186A/B, which in turn can be coupled to one or more corresponding threaded rods 188A/B. The threaded rods 188A/B can traverse through corresponding threaded bores 190A/B of a sliding member 192 to which the bearing wheel 178 can be rotationally coupled. In one embodiment, the sliding member 192 can be configured to slide along at least one rail 194A/B, which can be defined by a portion of the housing 110 within the interior cavity 112. Various gearing ratios between the first gear 184 and the one or more gears 186A/B have been contemplated to obtain a desired bearing wheel adjustment actuation speed. Accordingly, in one embodiment, the bearing wheel 178 can be driven to a desired distance from the output shaft 134 or bender shoe 102 to accommodate conduit of varying sizes.

In one embodiment, the housing 110 can include one or more bearing wheel markings 196A-C configured to aid a user in determining the location of the bearing wheel 178 relative to the output shaft 134. For example, the bearing wheel markings 196A-C can include ideal positional indications of the bearing wheel 178 for receipt of ½ inch EMT, ¾ inch EMT, and 1 inch EMT; although other positional markings are also contemplated. In some embodiments, an arrow 198 or other alignment indicator can be present on the sliding member 192.

Figure 9A:
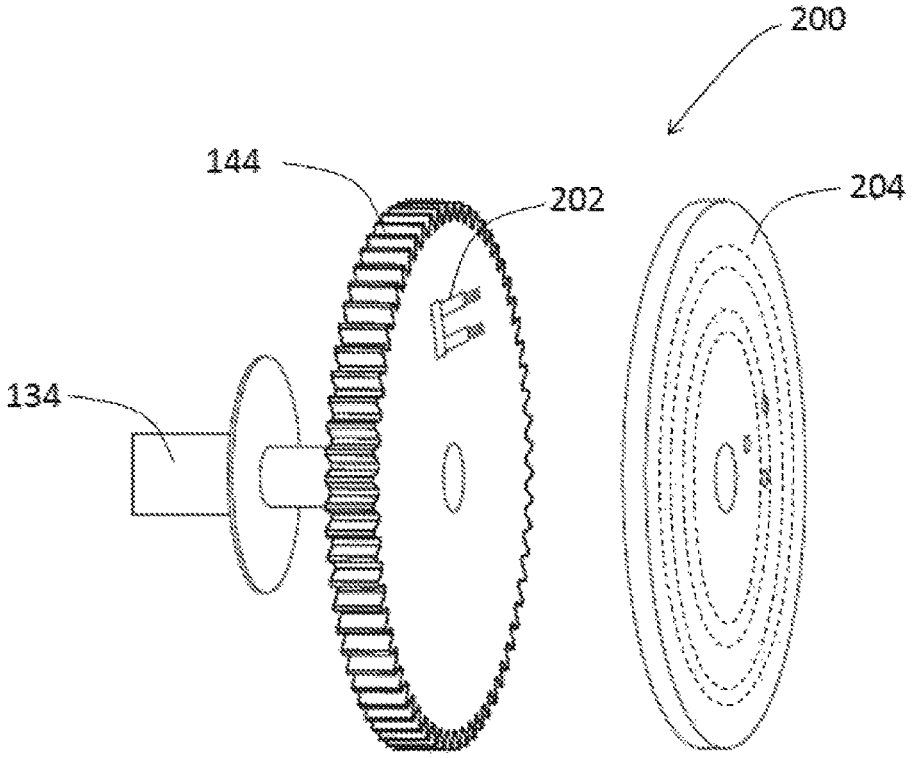
FIG. 9A is a schematic view depicting a sensor for a conduit bender, in accordance with an embodiment of the disclosure.
Figure 9B:
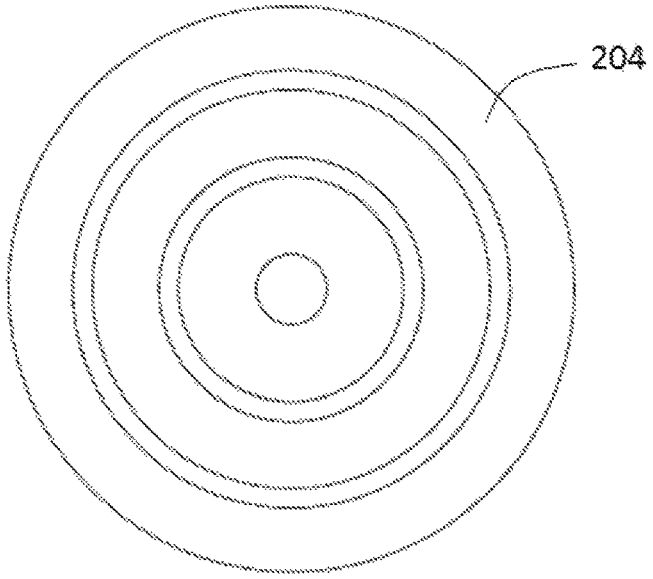
FIG. 9B is a plan view depicting a portion of the sensor of FIG. 9A.

In one embodiment, the conduit bender 100 can have angular position sensing capabilities of the rotating components relative to stationary components. In these embodiments, the conduit bender 100 can include an angular position sensor 200 configured to sense rotation of at least one of the driven shaft 128, components of the reductive gear set 108, output shaft 134, or bender shoe 102, relative to the housing 110. In one exemplary embodiment depicted in FIGS. 9A-B, at least a first portion 202 of the sensor 200 can be operably coupled to a portion of the reductive gear set 108, and can be configured to rotate during operation. A second portion 204 of the sensor 200 can be coupled to a stationary component (e.g., within the interior cavity 112 of the housing 110). Accordingly, rotation of the first portion 202 relative to the second portion 204 can provide information regarding the angular position of the rotating components relative to the stationary components. In other embodiments, the sensor 200 can be configured to sense rotational movement of the motor 106 or driven shaft 128.

Figure 2C:
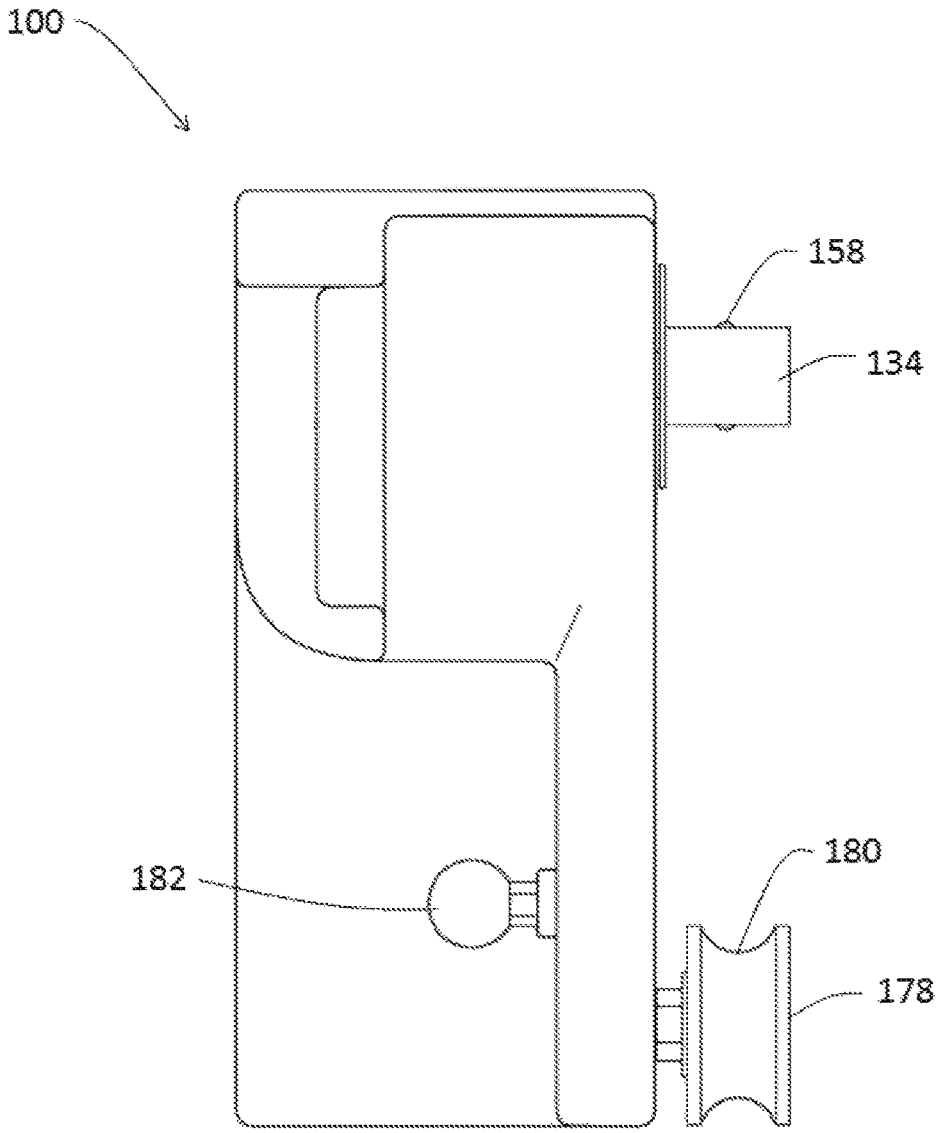
FIG. 2C is a front profile view depicting the conduit bender of FIG. 2A.
Figure 2D:
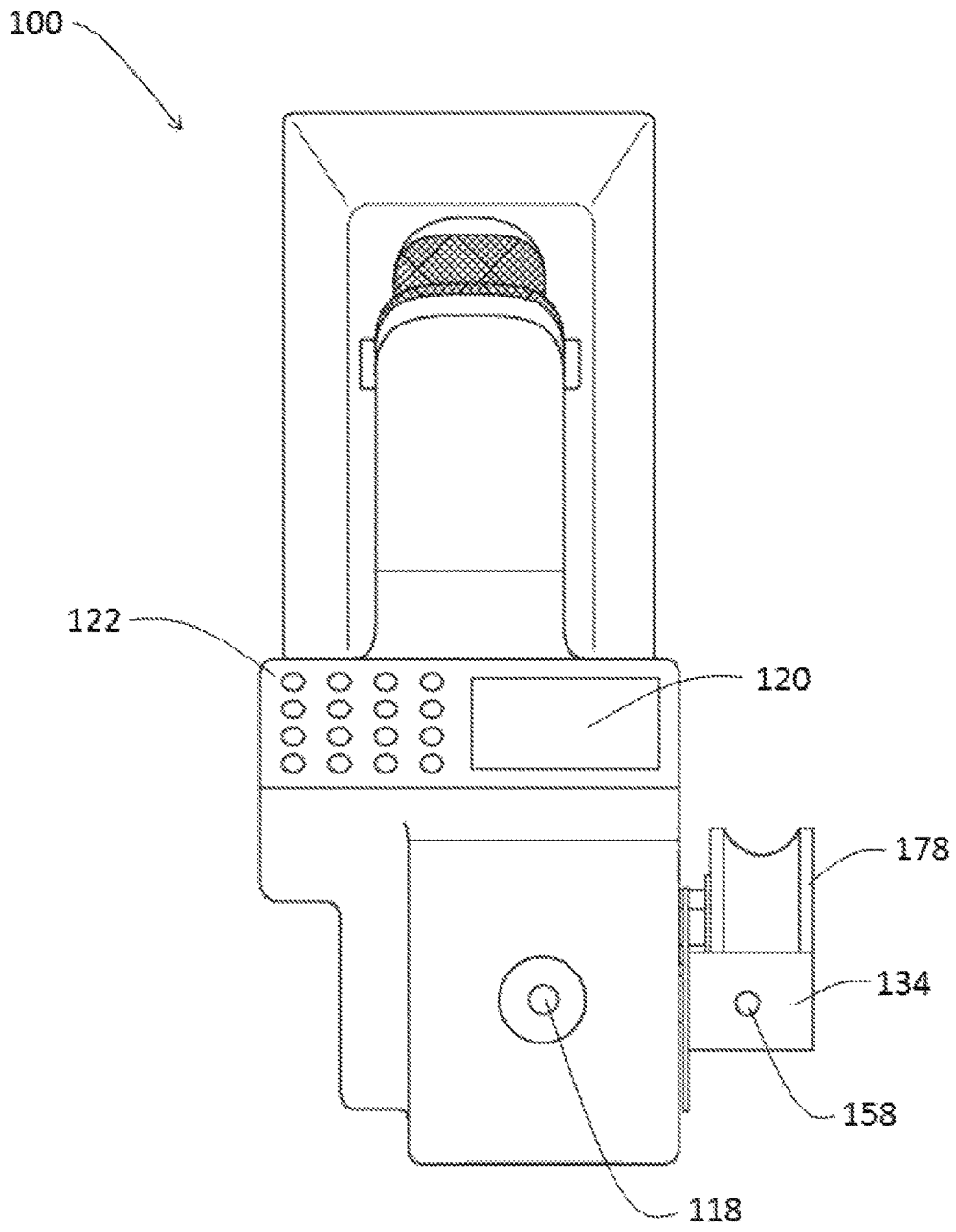
FIG. 2D is a top plan view depicting the conduit bender of FIG. 2A.

With continued reference to FIGS. 3B and 2D, as well as FIG. 9, in some embodiments, the conduit bender 100 can include a display 120 configured to display an angular position of rotating components (e.g., the bender shoe 102) relative to stationary components (e.g., the housing 110). In some embodiments, the motor 106 can be smart (e.g., programmable), such that a user can input a desired angular position of the bender shoe 102 into a keypad 122 or other user interface (e.g., a smartphone or other mobile computing device) coupled to a programmable controller 206 (as depicted in FIG. 10), prior to actuating the motor 106 (e.g., via trigger 132 or foot pedal 104). For example, in one embodiment, a user can utilize a mobile computing device, such as a cellular phone or tablet, in a wired or wireless connection with the programmable controller 206 to transmit information to and receive information from the programmable controller 206. Upon actuating the motor 106, the programmable controller 206 can automatically cease operation of the motor 106 upon completing the number of rotations sufficient to reach the desired angular position.

In one embodiment, the bearing wheel driver 182 can be at least partially controlled by the programmable controller 206. Accordingly, in one embodiment, the display 120/keypad 122 or other user interface can be configured to accept a desired conduit size, such that during bending operations the programmable controller 206 can automatically drive the bearing wheel 178 to a desired distance from the output shaft 134 via the bearing wheel driver 182 based on the accepted desired conduit size. In one embodiment, the programmable controller 206 can be configured to automatically drive the actuatable bearing wheel 178 from an initial position to a desired distance from the output shaft 134 via the bearing wheel driver 182 to commence bending operations, and return the actuatable bearing wheel 178 to the initial position via the bearing wheel driver 182 upon completion of bending operations. In one embodiment, one or more buttons on the keypad 122 are configured to enable manual adjustment of the bearing wheel driver 182, which in some embodiments can supplement control of the driver 182 by the programmable controller 206.

In one embodiment, one or more buttons on the keypad 122 can control a work light 208 (as depicted in FIG. 2A) configured to illuminate a portion of the conduit in proximity to the bending shoe 102 and bearing wheel 178. In one embodiment, the display 120/keypad 122 includes a smart bend angle calculator configured to determine a multiplier to determine spacing of bends, including offset and segmented bends.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A portable, handheld, self-contained, conduit bender, comprising:

a motor configured to rotate a driven shaft at a first rotational output;

a reductive gear set operably coupling the driven shaft to an output shaft, the reductive gear set configured to reduce the first rotational output of the driven shaft to a second rotational output of the output shaft;

a handheld housing defining an interior cavity configured to house the motor and the reductive gear set, such that only a portion of the output shaft emerges from the interior cavity, thereby improving safety and extending the life of the conduit bender by limiting exposure of the motor and the reductive gear set to dust and debris;

a bender shoe coupleable to the output shaft, the bender shoe defining an arcuate channel configured to receive conduit during bending operations; and a bearing wheel configured to guide and support conduit during bending operations, wherein the bearing wheel is movable to a desired distance from the output shaft to accommodate conduit of varying sizes.

2. The portable conduit bender of claim 1, wherein the arcuate channel of the bender shoe is configured to receive at least one of Electrical Metallic Tubing (EMT), Rigid Metal Conduit (RMC), Intermediate Metal Conduit (IMC), copper tubing, stainless steel tubing, tubing used for use in HVAC or refrigeration systems, tubing used in elevator systems, or other types of tubing or conduit.

3. The portable conduit bender of claim 1, wherein the output shaft includes a quick release configured to enable ease in interchangeability of one or more bender shoes, during a coupling of the one or more bender shoes to the output shaft.

4. The portable conduit bender of claim 1, wherein movement of the bearing wheel is driven by an actuation motor.

5. The portable conduit bender of claim 1, further comprising a built-in level configured to aid in leveling the conduit bender relative to a gravitational frame of reference along at least an x- and y-axis.

6. The portable conduit bender of claim 1, wherein the motor is at least one of electrically, hydraulically, or pneumatically powered.

7. The portable conduit bender of claim 1, wherein the reductive gear set includes at least one compound gear.

8. The portable conduit bender of claim 1, further comprising a sensor configured to sense an angular position of the bender shoe relative to the housing.

9. The portable conduit bender of claim 8, further comprising a display configured to display a digital readout of an angular position of the bender shoe.

10. The portable conduit bender of claim 9, wherein the display further includes a user interface is configured to accept a desired angular position of the bender shoe relative to the housing.

11. The portable conduit bender of claim 10, further comprising a programmable controller configured to automatically cease operation of the motor upon reaching the desired angular position as determined by the sensor.

12. The portable conduit bender of claim 1, further comprising a work light configured to illuminate at least a portion of conduit in proximity to the bender shoe.

13. A handheld, self-contained conduit bender, comprising:

a driver configured to drive a driven shaft at a first rotational output;

a reductive gear set operably coupling the driven shaft to an output shaft, the reductive gear set configured to reduce the first rotational output of the driven shaft to a second rotational output of the output shaft;

a handheld housing defining a handgrip enabling user manipulation of the conduit bender, and an interior cavity configured to house the driver and the reductive gear set, such that only a portion of the output shaft extends to an exterior of the housing; and a bender shoe coupleable to the output shaft; and a bearing wheel configured to guide and support conduit during bending operations, wherein the bearing wheel is movable to a desired distance from the output shaft to accommodate conduit of varying sizes.

14. The portable conduit bender of claim 13, wherein the bender shoe includes an arcuate channel configured to receive at least one of Electrical Metallic Tubing (EMT), Rigid Metal Conduit (RMC), Intermediate Metal Conduit (IMC), copper tubing, stainless steel tubing, tubing used for use in HVAC or refrigeration systems, tubing used in elevator systems, or other types of tubing or conduit.

15. The portable conduit bender of claim 13, further comprising a built-in level configured to aid in leveling the conduit bender relative to a gravitational frame of reference.

16. The portable conduit bender of claim 13, further comprising a sensor configured to sense an angular position of the bender shoe relative to the housing.

17. The portable conduit bender of claim 16, further comprising a display configured to display a digital readout of an angular position of the bender shoe.

18. The portable conduit bender of claim 17, wherein the display further includes a user interface configured to accept input from a user.

19. A method of constructing a self-contained conduit bender, comprising:

forming a handheld housing defining an interior cavity and a handgrip;

positioning a motor configured to rotationally drive a driven shaft within the interior cavity;

positioning a reductive gear set configured to operably couple the driven shaft to an output shaft within the interior cavity, such that only a portion of the output shaft emerges from the interior cavity;

forming a bender shoe coupleable to the output shaft; and positioning a bearing wheel on an exterior of the handheld housing, wherein the bearing wheel is configured to guide and support conduit during bending operations, and is movable to a desired distance from the output shaft to accommodate conduit of varying sizes.

* * * * *